US006283320B1

(12) United States Patent
Patch

(10) Patent No.: US 6,283,320 B1
(45) Date of Patent: Sep. 4, 2001

(54) CONDUCTIVE PLASTIC CONTAINER FOR VOLATILE LIQUIDS

(76) Inventor: Roger Patch, 23745 Immelman Circle, Chugiak, AK (US) 99567

( * ) Notice: Subject to any disclaimer, the term of this patent is extended or adjusted under 35 U.S.C. 154(b) by 0 days.

(21) Appl. No.: 09/747,152

(22) Filed: Dec. 20, 2000

(51) Int. Cl.[7] ..... B65D 90/46

(52) U.S. Cl. ..... 220/88.1; 220/567.2; 220/694; 215/386

(58) Field of Search ..... 220/88.1, 694, 220/567.2, 729, 735, 751; 361/215; 215/386

(56) References Cited

U.S. PATENT DOCUMENTS 4,540,191 * 9/1985 Hoch .
4,819,837 * 4/1989 Goforth .
4,858,061 * 8/1989 Hethcoat .
5,113,303 * 5/1992 Herres .
5,159,523 * 10/1992 Claassen et al. .
5,498,372 * 3/1996 Hedges .
5,514,299 * 5/1996 Kalwara .
5,816,332 * 10/1998 Alhamad .
6,127,934 * 10/2000 Powell, Jr. et al. .

* cited by examiner

*Primary Examiner*—Stephen Castellano
(74) *Attorney, Agent, or Firm*—Sanford J. Asman

(57) ABSTRACT

A container for volatile liquids, such a gasoline, is made of a conductive plastic material. An electrical connection is made to the container, such as by using a metal hose clamp around the neck of the container (or a threaded stud which is molded into the container), so that a conductive cable can be electrically attached to the container. At the distal end of the conductive cable a spring loaded electric clip is attached, whereby the electric clip can be connected to a conductive portion on the equipment which is to be fueled. By using the present invention, the benefits of a plastic fuel container, including arbitrary shape, absence of denting or corrosion, light weight, and inclusion of a molded handle, can all be derived without the detrimental effect of build-up of static charge which can lead to an explosion if a spark ignites volatile fuel-air vapors.

20 Claims, 3 Drawing Sheets

CONDUCTIVE PLASTIC CONTAINER FOR VOLATILE LIQUIDS

BACKGROUND OF THE INVENTION

The present invention relates to containers for carrying and transporting volatile liquids. In particular, the invention relates to a portable container which is particularly suitable for transporting flammable liquids and fuels, such as gasoline.

Flammable liquids, such as gasoline, are often carried in portable containers. By way of example, bush pilots often find it is necessary to carry more fuel than their aircraft can carry in their standard wing tanks, so that after landing in the bush or in a remote location where fuel is not available, they can replenish the fuel tanks of their aircraft. Fuel is also commonly carried in portable containers for use with off-road vehicles and for use by automobile racing teams. Home owners often use portable fuel containers to hold fuel for household devices such as lawn mowers, snow blowers, and for gardening and landscaping equipment. A problem with fueling equipment or vehicles with a volatile, flammable fuel, such as gasoline, is that gasoline vapors are highly flammable, and they are subject to exploding. When gasoline vapors mix with air, an extremely volatile mixture is formed. A spark can ignite this mixture, resulting in an explosive reaction and a fire.

Gasoline is generally carried in either metal or plastic containers. Because metal containers are conductive, they do not build up static charges, as do non-conductive plastic containers of the type heretofore known and used. Also, when metal containers touch the metal fuel filler of an aircraft, either directly, or by using a "grounding strap" of the type used when fuel trucks are used to refuel aircraft, preferably before the container is opened, i.e., before any vapors can form, the potential for a static discharge spark is eliminated. Plastic fuel tanks, of the type heretofore known, have not been made of electrically conductive material, so a static discharge could readily build up on such containers, particularly when used in the cold, dry climates of places like Alaska, where static charges build up easily, but cannot readily find a path to ground. Simply pouring fuel from a container causes a static buildup, which can result in a spark from a static electricity discharge. Alternatively, when it rains, particularly during light rains and drizzles, the rain drops carry an electric charge. If an aircraft is out in the rain its airframe will become charged, and if an attempt is made to fueled it while it is so charged, there is a possibility that a static discharge will occur, resulting in an explosion.

While one would think that the possibility of a fire would be a deterrent to the use of plastic fuel containers, for a number of other reasons plastic containers are preferred over metal containers. Among those reasons are that plastic containers are typically lighter in weight than similar sized metal containers, plastic containers can be molded into arbitrary shapes, plastic containers do not rust, and plastic containers do not dent, scratch, or scratch other items with which they come into contact. In fact, plastic containers are generally preferred, except where they have been banned due to the danger which they impose, e.g, on a number of automotive race tracks.

In order to avoid a fire during a fueling operation, sparks must be avoided, as fuel vapors are inevitably present, and they are invisible, making it difficult to determine their presence. By using a metal gas can, which is electrically connected to the equipment or vehicle, one can assure that the fuel tank and the equipment or vehicle being fueled are at the same electrical potential, thereby minimizing, or eliminating the risk of sparks due to static discharge. However, due to the aforementioned undesirable characteristics of metal fuel containers, e.g., they are prone to denting and rusting, they are heavy, and they are not easily produced in arbitrary shapes, plastic fuel containers are generally preferred over metal fuel containers. Plastic is not typically as strong as metal, nor is it generally conductive. Thus, while plastic fuel containers have been designed, and while they are readily available, the standard plastic filled containers which one can readily purchase are not conductive, so they cannot include means for electrically connecting them to the equipment or vehicle during a fueling operation in order to prevent a static discharge which can potentially ignite the fuel-air vapor which is inevitably present causing an explosion.

In view of the foregoing, it would be desirable to have a conductive fuel container which includes means for providing electrical connection to a vehicle or other piece of equipment which was being fueled so as to provide all of the desirable attributes of a plastic fuel container while still providing a means for electrically attaching the container to the equipment being refueled, whereby there will be no potential difference between the fuel container and the equipment.

Unfortunately, traditional methods for achieving conductive plastics have been unsatisfactory. In particular, either high levels of carbon black have been incorporated via dry blending or melt compounding, or anti-static additives have been used. It has been found that high levels of carbon black severely reduce the properties of the base resin into which they are incorporated, high levels of carbon black severely affect the resin, resulting in poor melt flow characteristics and poor mold fill, and the performance of anti-static additives has been found to degrade over time, as the anti-static additives bleed through the polymer.

Prior attempts to form a conductive plastic fuel container have been made, typically by blow molding processes, but those containers were found to have had walls which were too thin, or too brittle, or too soft, or which did contained air bubbles. Accordingly, these prior efforts failed to provide a conductive plastic fuel container which is strong enough to pass the U.S. Department of Transportation's "drop test".

SUMMARY OF THE INVENTION

The present invention is a conductive plastic container intended for use with flammable liquids, such as gasoline. The container of the present invention is made of an electrically conductive plastic which includes a grounding strap, along with means for electrically connecting the conductive plastic container to a fuel tank which is being filled with fuel from the container, whereby the likelihood of a spark between the fuel tank and the plastic container is virtually eliminated.

DETAILED DESCRIPTION OF EXEMPLARY EMBODIMENTS

Figure 1:
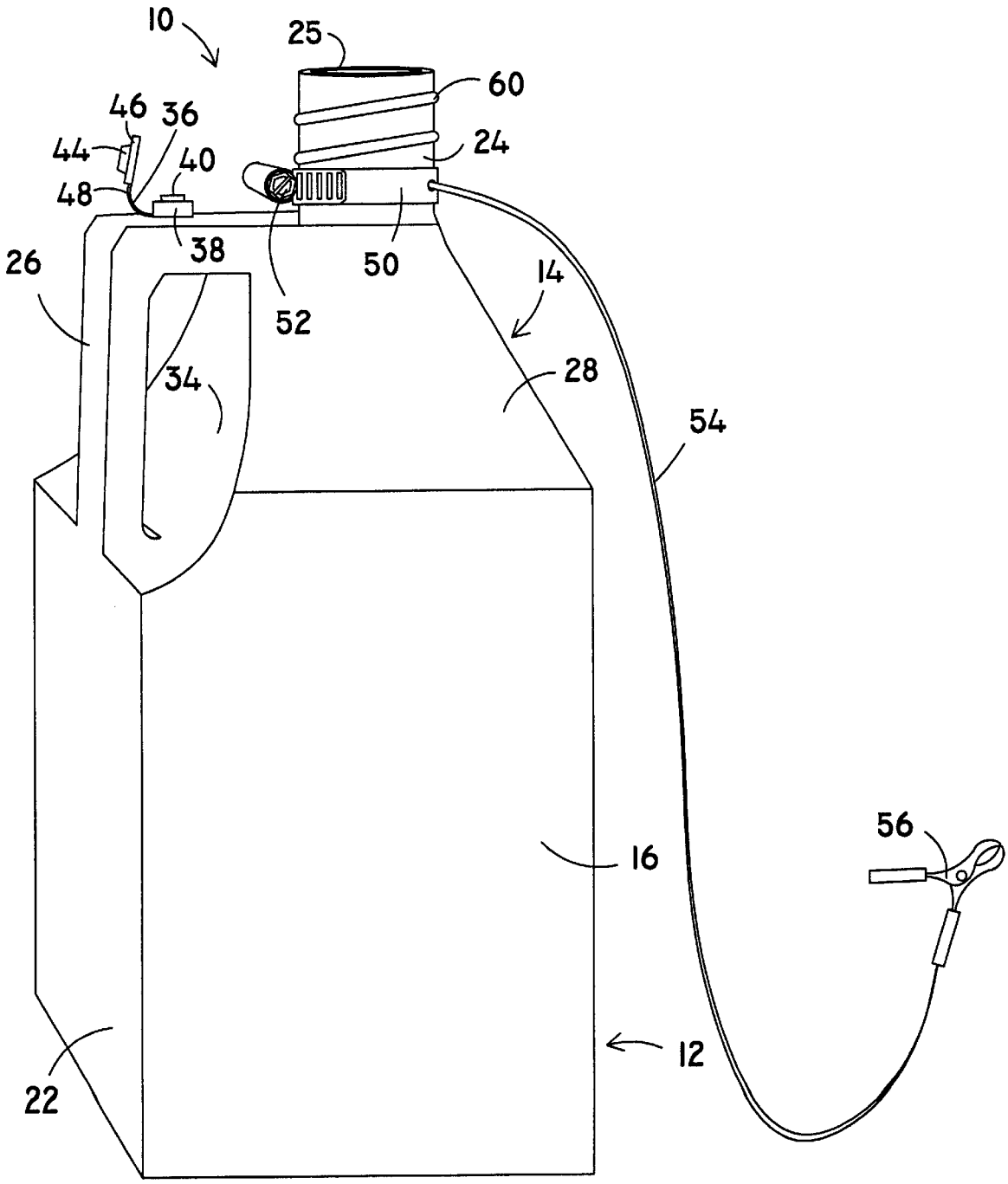
FIG. 1 is a perspective side view of the fuel container of the preferred embodiment of the present invention.
Figure 2:
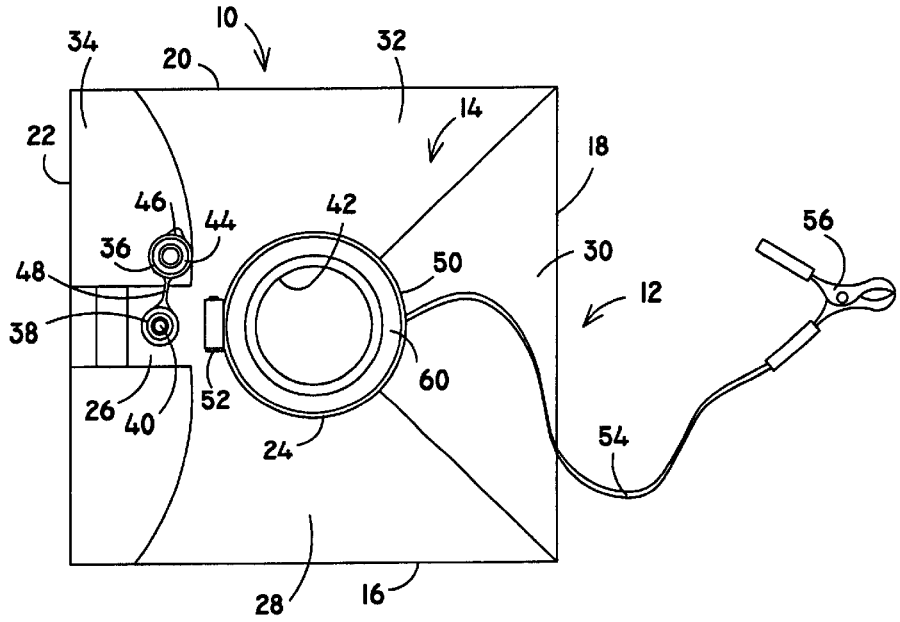
FIG. 2 is a top view of the fuel container of the present invention.

Referring first to FIGS. 1 and 2, the preferred embodiment of a conductive plastic fuel container 10 for volatile liquids, made in accordance with the invention, is shown. In the preferred embodiment of the invention, the container 10 is made of a conductive plastic which allows it to be molded into any desired shape. As used herein, the term "conductive plastic" is used to refer to a plastic material which has adequate electrical conductivity to allow for an electrical connection on the container 10 to bleed off any static charges on the container 10. In the preferred embodiment of the invention, the container 10 is molded using a rotational molding process ("rotomolded") using a semi-conductive polyethylene called ICORENE™ by its supplier, Rotec. An advantage of ICORENE™ is that it provides a conductive plastic without the disadvantages of prior known approaches to making anti-static plastics. Those skilled in the art will recognize, however, that any conductive plastic could be used, so long as it provides the same, or similar qualities to ICORENE™. One particular advantage of ICORENE™ is that it has been found that the container 10 of the present invention can be molded using a rotomold process to form a conductive plastic container having sufficient strength to pass the "drop test" of the U.S. Department of Transportation.

As will be understood by those skilled in the art, rotational molding is a technique for the fabrication of parts from powdered thermoplastic material in which the thermoplastic material is placed within a hollow mold and the mold is rotated in a heated environment until the thermoplastic material fuses and coats the entire interior surface of the mold. Included in the apparatus is a holding mechanism for the mold and a power mechanism to provide the required rotational motion to the mold. The power mechanism typically provides for simultaneous rotation of the mold about two orthogonal axes and is displaced spatially from the holding mechanism. The holding mechanism is attached to a translating mechanism which positions the molds both internal to and external to a heating chamber such as an oven while keeping the drive mechanism external of the oven at all times. The body of the container 10 of the preferred embodiment of the invention is rotomolded by Scribner Plastics, located at 2483-B Mercantile Drive, Rancho Cordova Calif. 95742 (Telephone: (800) 552-5847 or (916) 638-1515; Fax: (916) 638-2278).

With reference to the drawing, the container 10 of the preferred embodiment of the invention is formed with a lower main tank portion 12 which is substantially rectangular in cross-section and which is substantially in the form of a rectangular prism. In the preferred embodiment of the invention, a five gallon container has a lower tank portion 12 which has a cross-section which is approximately nine inches square. While the tank portion 12 of the container 10 could be formed in virtually any shape, a rectangular shape has, as a first advantage, the fact that multiple containers can be stored adjacent one another without wasting significant space, as would be the case if the container 10 was cylindrical. Another advantage of forming the container 10 of the preferred embodiment of the invention as a rectangular prism is that the container 10 cannot roll, should it be tipped over on its side.

As shown in FIGS. 1 and 2, the main tank (lower) portion 12 of the container 10 of the preferred embodiment of the invention has sides 16, 18, 20, 22 which from a rectangle when viewed from above (See, FIG. 2), while the upper portion 14 of the container 10 has sides 28, 30, 32, 34 which slope inward toward a neck portion 24 which has an internal opening 25 with a diameter of about 2¾ inches in the preferred embodiment. By having the sides 28, 30, 32, 34 of the upper portion 14 of the container 10 slope inward, it is possible to integrate a handle portion 26 into the upper portion 14 of the container 10 while keeping the handle portion 26 within the outer periphery of the side walls 16, 18, 20, 22. Another advantage of the inwardly sloping side walls 16, 18, 20, 22 of the upper portion 14 of the container 10, is that it locates the neck 24 of the container 10 substantially in the middle of the container 10 when viewed from the top (See, FIG. 2). This means that when the container 10 is tilted for pouring fuel (See, FIG. 6), any accumulated debris (which is typically heavier than fuel) which is in the fuel will tend to slide down the sloped wall 30, back into the lower portion 12 of the container 10, rather than being poured out of the container 10 with the fuel.

Figure 6:
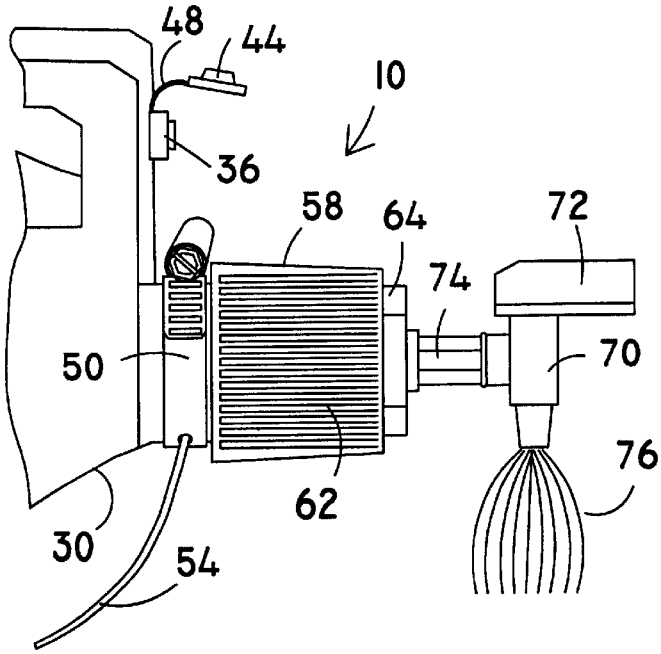
FIG. 6 is a perspective side view of the top portion of the fuel container of the preferred embodiment of the present invention illustrating the container on its side in the filling position with its air vent opened, and with an open spigot attached to the filler cap.

As shown, the preferred embodiment of the container 10 further includes an air vent 36, which has a fixed portion 38, having a central opening 40 which allows air to enter the container 10 when fuel is being poured out of the opening 42 formed in the neck 24 (See, FIG. 6). The air vent 36, is preferably made of plastic, and it includes a cap 44, having a tab 46 formed thereon to facilitate the removal of the cap 44 from the fixed portion 38 of the air vent 36. As will be understood by those skilled in the art, the air vent 36 is closed by snapping the cap 44 onto the fixed portion 38, and it is opened by pulling up from under the tab 46. As the air vent 36 is preferably formed of plastic, the cap 44 and the fixed portion 38 are preferably joined by a retainer portion 48 which prevents loss of the cap 44 when the air vent 36 is open during a fueling operation (See, FIGS. 1 and 6).

With continued reference to FIGS. 1 and 2, the present invention requires a means for making electrical contact to the container 10. In the preferred embodiment of the invention, the means for making electrical contact to the container 10 is a conductive band 50 which is fitted to the neck 24 of the container 10 so as to make electrical contact with the container 10. In the preferred embodiment of the invention the electrically conductive band 50 is comprised of a hose clamp which is fitted around the lower portion of the neck 24 of the container and then tightened by turning the screw 52 formed on the hose clamp 50. A conductive cable 54 is attached to the hose clamp 50 at one end. The other end of the conductive cable 54 is preferably attached to a spring loaded electric clip 56, adapted to be clipped to a conductive portion of the vehicle, or equipment, being fueled, whereby a continuous electric path is formed between the equipment being fueled and the container 10, with an electrically conductive path that runs from the clip 56, through the conductive cable 54, then through the hose clamp 50, to the container 10, thereby preventing the buildup of a static charge between the container 10 and the equipment being fueled. In the preferred embodiment of the invention, the clip can be the 10-amp clip sold by Radio Shack, as Part No. 27-344. The conductive cable 54 is preferably formed of a conductive material which resists corrosion, such as braided stainless steel aircraft cable, which is about 3/32 inch in diameter.

Figure 3:
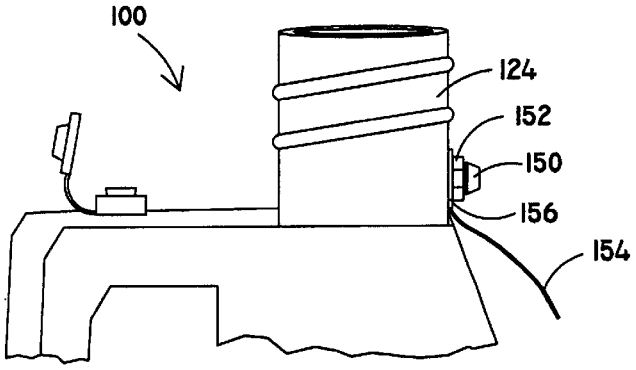
FIG. 3 is a perspective side view of the top portion of an alternative embodiment of the fuel container of the present invention.

While the means for making electrical contact to the container 10 is a conductive band 50 (e.g., a hose clamp) which is fitted to the neck 24 of the container 10, as shown in FIGS. 1–2, other means for making electrical contact can be used as an alternative to the hose clamp 50. Thus, with reference to FIG. 3, an alternative embodiment of the invention is shown. In the embodiment of the container 100, shown in FIG. 3, the container 100 is molded with one end (not shown) of a conductive, threaded stud 150 formed in the container 100. Preferably, the stud 150 is formed of brass, or other suitable, conductive material. A terminal connector 156, having a conductive cable 154 attached thereto, can be slipped over the threaded stud 150, and it can be tightened in place, to assure good mechanical and electrical contact, by tightening a nut 152 which is threaded onto the stud 150. As will be obvious to those skilled in the art, other means for making electrical contact could be used in lieu of the hose clamp 50 (FIGS. 1–2) or the stud 150 (FIG.3).

Figure 4:
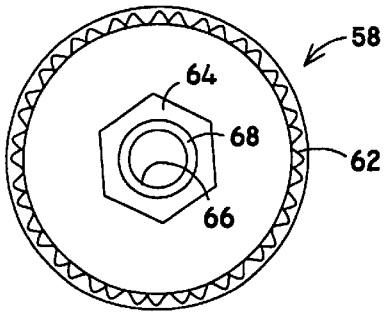
FIG. 4 is a top view of the preferred embodiment of the filler cap for the fuel container of the present invention.
Figure 5:
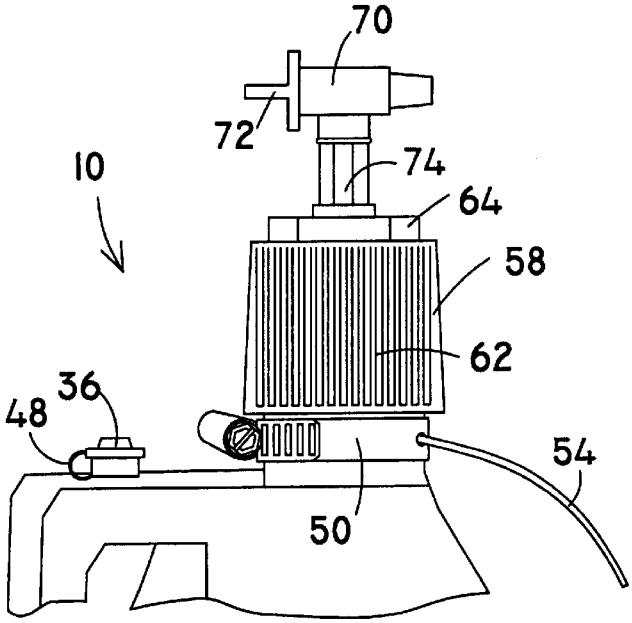
FIG. 5 is a perspective side view of the top portion of the fuel container of the preferred embodiment of the present invention illustrating the container in the storage position with its air vent closed, and with a closed spigot attached to the filler cap.

With reference to FIGS. 4–6, the filler cap 58 which is used in the preferred embodiment of the invention is formed of plastic, and it has internal threads (not shown) which allow it to be screwed onto the threads 60 on the neck portion 24 of the container 10 (See, FIGS. 1–2 and 5–6). In the preferred embodiment, the filler cap 58 includes a knurled portion 62 to provide a good gripping surface for hand tightening the filler cap 58 onto the container 10. The filler cap 58 further includes a hexagonal portion 64 which extends up from the filler cap 58 to allow the use of a tool, such as a wrench, to tighten the filler cap 58 onto the top of the container 10.

In the preferred embodiment of the invention, an opening 66 having an internal diameter of about one inch, is formed through the top of the filler cap 58. The inside of the opening 66 is threaded, whereby a plug (not shown) can be used to seal the opening 66 by screwing it into the opening 66. Alternatively, a hose or other options (not shown), can be screwably attached to the opening 66. As shown in FIGS. 5–6 a spigot 70 can be left screwed into the opening 66, or it may be attached to the opening 66 solely for use in fueling operations. The spigot 70 of the preferred embodiment of the invention is made of plastic, and it is commercially available from National-Spencer, Inc. located in Wichita, Kans. The spigot of the preferred embodiment has a ball valve inside of it, which allows it to be easily closed (as shown in FIG. 5) or opened (as shown in FIG. 6) by merely turning a handle 72 ninety degrees. The use of the spigot 70 makes it easy to open or close the container 10 to allow for fuel flow, even when it is very cold and when ones' hands are in gloves or mittens. As shown in FIGS. 5 and 6, the spigot 70 also includes a portion 74 having a hexagonal cross-section which allows the spigot 70 to be tightened onto the filler cap 58 using a wrench or other suitable tool.

With particular reference to FIG. 6, which shows the container 10 being used for fueling, when the handle 72 is in the open position, and the air vent 36 is opened, fuel 76 readily flows out of the spigot 70 when the container is tilted.

As will be understood by those skilled in the art prior to filling equipment with fuel, the person conducting the fueling operation should first attach the conductive clip 56 to an exposed metal portion of the equipment, or aircraft, being fueled. For safety, the portion to which the clip 56 is attached should be away from the area where fuel vapor may be present. After the clip has been attached, it is safe to open the spigot 70 by turning the handle 72, to open the air vent 36, which allows air to enter the container 10 as fuel is being poured, and to conduct the fueling operation in the standard manner.

While a number of variations have been described, others will appear to those skilled in the art, and all such variations are intended to be included as variations of the present invention.

Thus, while a rotational molding process is used to make the container 10 of the preferred embodiment of the invention, it will be understood by those skilled in the art that a blow molding process could be used provided that the container could be formed with an appropriate conductive plastic. By using a blow molding process, containers in accordance with the invention could be formed in virtually any shape.

I claim:

1. A container for volatile liquids, comprising:

(a) a hollow plastic body adapted to hold a liquid, said body being made of an electrically conductive plastic, said plastic body formed with at least one opening for allowing liquid to be added to said container or poured from said container;

(b) means for making electrical contact to said plastic body;

(c) an electric clip for electrically making electrical contact to a piece of equipment to which liquid is to be transferred from said container; and (d) cable means for connecting said electric clip to said means for making electric contact, whereby said electric clip can be connected to said piece of equipment thereby insuring that said container and said piece of equipment are at the same electric potential, so as to prevent a static electric discharge from occurring while liquid is transferred from said container to said piece of equipment.

2. The container of claim 1 wherein said hollow plastic body is formed in the shape of a fuel container.

3. The container of claim 2 wherein said hollow plastic body is formed in the shape of a fuel container with a neck at its upper end and a filler opening extending through said neck, said neck communicating with the inside of said container, whereby ingress to and egress from said container of liquids can be accomplished through said filler opening.

4. The container of claim 3 wherein said neck is cylindrical in shape, and the upper portion of said neck is threaded, whereby a filler cap can be screwably attached to close said filler opening and seal said container.

5. The container of claim 4 wherein said hollow plastic body is formed with a vent opening which is located on said body in a location which will make it higher than said filler opening when liquid is being poured out of said filler opening, whereby air can enter said container as fluid leaves said container.

6. The container of claim 5 wherein said air vent is fitted with a cap which can be removed when liquid is poured from said container.

7. The container of claim 6 wherein said cap is adapted to snap onto said air vent.

8. The container of claim 7 wherein said cap and said air vent are formed of plastic and they are attached to each other by a retainer.

9. The container of claim 8 wherein said container is formed with an integrated handle.

10. The container of claim 9 wherein said integrated handle is hollow and is internally connected with the inside of the body of said container, whereby fluid from said container can enter said handle.

11. The container of claim 10, wherein said air vent is mounted in said handle, whereby said air vent will be above said filler opening when said container is tilted to pour fluid out of said filler opening.

12. The container of claim 11 further comprising a filler cap adapted to be screwed onto said threaded portion of said neck.

13. The container of claim 12 wherein said filler cap includes a threaded opening into which a spigot can be screwably mounted.

14. The container of claim 13 wherein said means for making electrical contact to said plastic body is comprised of a conductive strap attached to said neck.

15. The container of claim 14 wherein said conductive strap encircles said neck.

16. The container of claim 15 wherein said conductive strap is comprised of a hose clamp.

17. The container of claim 13 wherein said means for making electrical contact to said plastic body is comprised of a threaded, conductive stud which is attached to said container.

18. The container of claim 17 wherein said container is molded and said threaded, conductive stud is molded into said container during the molding process.

19. The container of claim 1 wherein said electric clip is a spring loaded clip.

20. The container of claim 19 wherein said cable means is comprised of a stainless steel cable.

* * * * *